US011078706B2

(12) United States Patent
Janda et al.

(10) Patent No.: US 11,078,706 B2
(45) Date of Patent: Aug. 3, 2021

(54) METHOD OF DOOR CONTROL WITHOUT HAND CONTACTING AND THE DEVICE CARRYING OUT THIS METHOD

(71) Applicant: EKOTES TRADE spol. s r.o., Zahorany (CZ)

(72) Inventors: Tomas Janda, Prague (CZ); Frantisek Janda, Prague (CZ)

(73) Assignee: EKOTES TRADE spol, s r.o., Zahorany (CZ)

( * ) Notice: Subject to any disclaimer, the term of this patent is extended or adjusted under 35 U.S.C. 154(b) by 130 days.

(21) Appl. No.: 16/079,263

(22) PCT Filed: Feb. 21, 2017

(86) PCT No.: PCT/IB2017/000137
§ 371 (c)(1),
(2) Date: Aug. 23, 2018

(87) PCT Pub. No.: WO2017/144965
PCT Pub. Date: Aug. 31, 2017

(65) Prior Publication Data

US 2019/0048638 A1 Feb. 14, 2019

(30) Foreign Application Priority Data

Feb. 24, 2016 (CZ) ..... CZ2016-107

(51) Int. Cl.
*E05F 11/04* (2006.01)
*E05F 11/22* (2006.01)
(Continued)

(52) U.S. Cl.
CPC ..... *E05F 11/04* (2013.01); *E05F 11/22* (2013.01); *E05F 11/54* (2013.01); *E05F 13/02* (2013.01);
(Continued)

(58) Field of Classification Search
CPC ..... E05F 13/02; E05F 11/04; E05F 11/54; E05Y 2900/112
(Continued)

(56) References Cited

U.S. PATENT DOCUMENTS 228,314 A * 6/1880 Clark ..... E05F 13/02 49/240
418,736 A * 1/1890 Means ..... E05F 13/04 49/274
(Continued)

FOREIGN PATENT DOCUMENTS

CN 2290938 Y 9/1996
DE 323128 C * 7/1920 ..... E05F 11/04
(Continued)

OTHER PUBLICATIONS

International Search Report and Written Opinion for PCT/IB2017/000137, filed Feb. 21, 2017, completed on Jun. 20, 2017, 9 pages.
(Continued)

*Primary Examiner* — Marcus Menezes
(74) *Attorney, Agent, or Firm* — Barnes & Thornburg LLP

(57) ABSTRACT

The method of door control without, hand contact, wherein, when the door leaf is in its stationary closed position, all the energy necessary for automatic opening and subsequent closing the door leaf, initiated by an actuating force, preferably realized by means of a foot lever, is accumulated in an opening and closing mechanism during the actuating action of the controlling mechanism. During the automatic opening, the only acting force is the tension of the opening member, and during the subsequent automatic closing, the only acting force is the tension of the closing member. By
(Continued)

means of the bimodal opening and closing mechanism, the tensions of these two members act separately, not against each other.

4 Claims, 10 Drawing Sheets

(51) Int. Cl.
*E05F 11/54* (2006.01)
*E05F 13/02* (2006.01)
*E05F 1/10* (2006.01)

(52) U.S. Cl.
CPC ..... *E05F 1/1016* (2013.01); *E05Y 2201/676* (2013.01); *E05Y 2900/112* (2013.01); *E05Y 2900/132* (2013.01)

(58) Field of Classification Search
USPC ..... 49/359, 274
See application file for complete search history.

(56) References Cited

U.S. PATENT DOCUMENTS

| | | | | | |
|---|---|---|---|---|---|
| 560,478 | A * | 5/1896 | Cougill | E05F 13/04 | 49/274 |
| 750,363 | A * | 1/1904 | Hicks | E05F 13/04 | |
| 762,729 | A * | 6/1904 | Lee | E05F 13/02 | 49/263 |
| 839,330 | A * | 12/1906 | Stephenson | E05F 13/02 | 49/263 |
| 948,737 | A * | 2/1910 | McKee | E05F 11/54 | 49/272 |
| 993,941 | A * | 5/1911 | Alter | E05F 13/04 | 49/272 |
| 1,555,420 | A * | 9/1925 | Knox | E05F 11/54 | 49/274 |
| 1,611,386 | A * | 12/1926 | Stanley | E05F 13/02 | 49/263 |
| 2,634,970 | A * | 4/1953 | Rosebrook | E05F 13/02 | 49/344 |
| 5,205,015 | A * | 4/1993 | Huang | E05F 1/1215 | 16/297 |
| 2009/0320236 | A1 | 12/2009 | Yamamuro | | |
| 2013/0118085 | A1* | 5/2013 | Hedemark | E05F 11/54 | 49/356 |

FOREIGN PATENT DOCUMENTS

| | | | | |
|---|---|---|---|---|
| FR | 2979936 | A1 * | 3/2013 | E05F 13/02 |
| GB | 1266985 | A | 3/1972 | |
| JP | H02167975 | A | 6/1990 | |
| JP | H0953365 | A | 2/1997 | |
| JP | H11336413 | A | 12/1999 | |

OTHER PUBLICATIONS

Czech Republic Search Report for Czech Republic Patent Application No. PV 2016-107, completed on Oct. 25, 2016, 3 pages.

* cited by examiner

METHOD OF DOOR CONTROL WITHOUT HAND CONTACTING AND THE DEVICE CARRYING OUT THIS METHOD

CROSS-REFERENCE TO RELATED APPLICATIONS

This application is a national stage entry made under 35 U.S.C. § 371(c) of PCT International Application No. PCT/IB2017/000137, filed Feb. 21, 2017, which claims the benefit of Czech Republic Patent Application No. PV 2016-107, filed Feb. 24, 2016, the disclosures of both of which are incorporated herein by reference in their entirety

TECHNICAL FIELD

The disclosed embodiments relate to a door control without contact of the human hand, wherein a door leaf is provided with an opening and closing mechanism and a control mechanism. The disclosed embodiments also relate to a device for performing this method.

BACKGROUND

The prior art has long known closing mechanisms which automatically close a door or gate. These closing mechanisms are usually composed of various springs or even hydraulic systems that, when opening the door or gate, accumulate some energy that is used to automatically close the door or gate. Such closing mechanisms are often provided with damping elements to prevent slamming of the door. These closing mechanisms may be used in public spaces such as public welfare facilities in order to ensure automatic closure of areas, for example, public toilets and so on.

Known devices such as U.S. Patent Application Publication 2009/320,236 and Japanese Patent Application No. 0953365 teach that when opening the door by a traditional way by the force of the hand on the door leaf, accumulating part of the energy spent on opening does not result in subsequent automatic closure. Additionally, the energy which facilitates opening the door must be overcome by the force of the closing mechanism. Japanese Patent Application No. 02167975 teaches opening the door in a conventional manner, wherein when the door is opened halfway, then the door completely opens and then the door completely closes. All of the above devices fail to address controlling the door with another part of the body other than the hands, and activation is always necessary to move the leaf.

U.S. Patent Application Publication No. 2009/01450373 teaches a door closing mechanism provided in the direction of opening against a person using a leg or other body part. U.S. Patent Application No. 2013/0118085 teaches a door frame having a lever mechanism with a spring acting against the force of a closing spring. The disadvantage is that, when opening, it is necessary to overcome the force of the closing mechanism. These devices have a major drawback in that the operator must simultaneously apply work force and simultaneously give way to the opening door leaf. This complicates the use even for healthy people, disabled people, elderly people or children, that cannot use such a device in practice.

Additionally, there are electrical devices for automatically opening and closing doors Common drawbacks to these devices are the high cost, the need for power supply, regular electric revisions and ensuring safety in difficult conditions.

A particular problem of public toilets is the transmission of infectious diseases from hands of visitors, a solution to which can only be complete exclusion of hand contact with the door or the door fittings, especially when opening the door towards you. This problem is most serious in a situation where a human coming out of the stall toilet does not have any possibility to perform hand hygiene and must touch the unclean parts of the door. A similar problem occurs in public spaces in general, including fast food places, restaurants and cafeterias, offices, cinemas, concert halls, schools etc. This problem also occurs in sterile areas such as operating theaters, hospitals, clean production and so on. Finally, the aforementioned problem can occur even in private areas.

The closest known solution to the above problem in this respect is the device for door control according to Czech Republic Patent No. 304,182. This solution discloses a device wherein the opening mechanism operated by the foot door opening ensures that an exerted force overcomes the closing mechanism integrated in the door. The solution described in this patent, because of this principle, needs considerable power to open the door, and thus, it becomes difficult to open the door, e.g. for children or disabled persons.

The embodiments described herein disclose a process to control doors without contacting the human hand and the structure of the control system for a door that, when using the optimized operating force, allows the automatic opening and closing of the door without touching the door leaf by hand.

SUMMARY OF THE DISCLOSED EMBODIMENTS

The problem is solved and the drawbacks of the known solutions of this kind are largely eliminated by controlling the door without touching the human hand. The embodiments disclosed teach that in the action of optimizing external force on the door, when the door is closed, the force simultaneously activates an opening and closing mechanism fitted on the door leaf. When opening the door, the closing mechanism is blocked. When closing the door, the opening mechanism is blocked. Accordingly, the opening and closing force do not act against each other. The opening and closing mechanism is initiated by the control mechanism, which is preferably arranged in the lower region of the door leaf. It is obvious that if a control mechanism to be controlled preferably by foot, ideally by a shoe sole of a passing person, should be arranged in the lower area of the door leaf, preferably even at the lower edge of the door leaf.

The method of controlling the door without contacting a human hand is performed by a device having a door leaf that is provided with an opening and closing mechanism mounted preferably on the axis of the hinges of the door leaf. These mechanisms as a whole are connected with a control mechanism in the lower part of the door leaf.

The control mechanism, which works on a mechanical principle, is arranged in the lower region of the door leaf and enables opening of the door towards and away from the passing person, using a foot operated tread arm. Another possibility for controlling the door leaf lies in the fact that the opening and closing mechanism is pneumatic. The opening and closing mechanism may be a pneumatic-hydraulic device. The opening and closing mechanism may be a hydraulic energy accumulation device. The opening and closing mechanism is provided with a rotating member adapted so that, on actuation of the actuating mechanism, the rotating member is rotated either in an opposite direction to door leaf opening or, alternatively, in the opening direction of the door leaf. A control mechanism which is arranged in the lower part of the door leaf is provided with a tread arm.

A substantial advantage of the disclosed embodiments is that it completely eliminates the need to touch the door leaf by hand. Accordingly, the device substantially reduces the risk of transmission of infectious diseases and make visits of public toilet facilities for visitors more pleasant.

The solution described has a number of technical and economic advantages, including the possibility of installation on an existing door leaf and the fact that the function and operation of the door leaf it is not significantly affected by the installation. The device can also be used for blocking the door in the open position without touching a human hand. In the case that the installed opening and closing mechanism is not activated, the closing and opening mechanism works only as a door closer. The entire system is designed to prevent any damage by careless operation.

BRIEF DESCRIPTION

The device will be further illustrated by the drawings and diagrams, in which a mechanical solution is described using torsion springs for the opening and closing mechanism. It is activated by rotating the rotating member in an opposite direction to the opening direction of the door leaf.

Figure 3A:
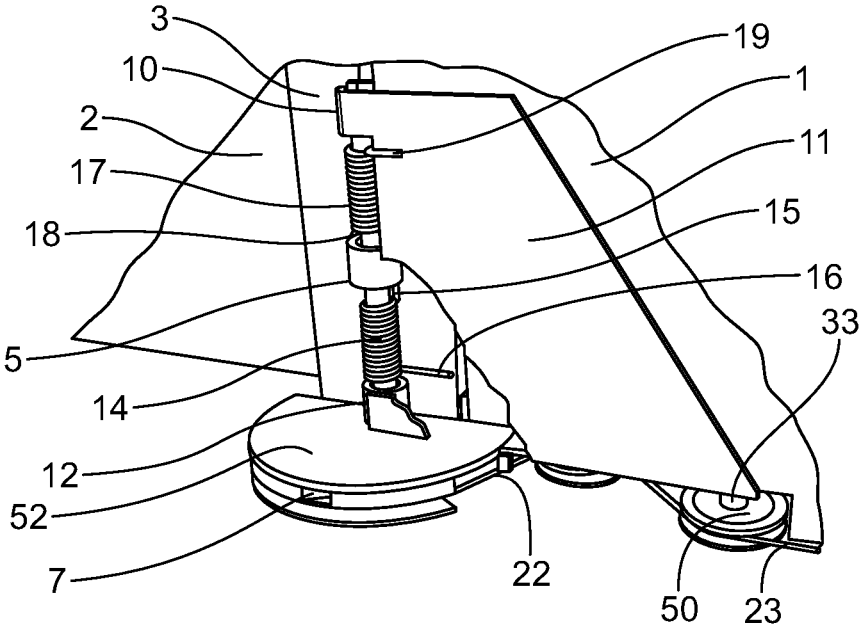
Figure 3B:
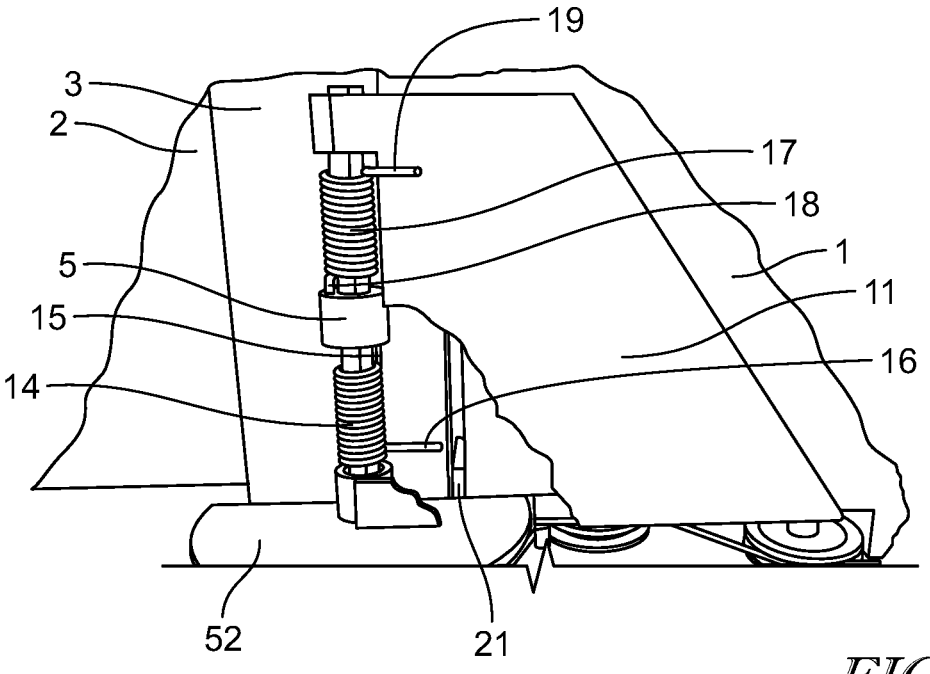
Figure 3C:
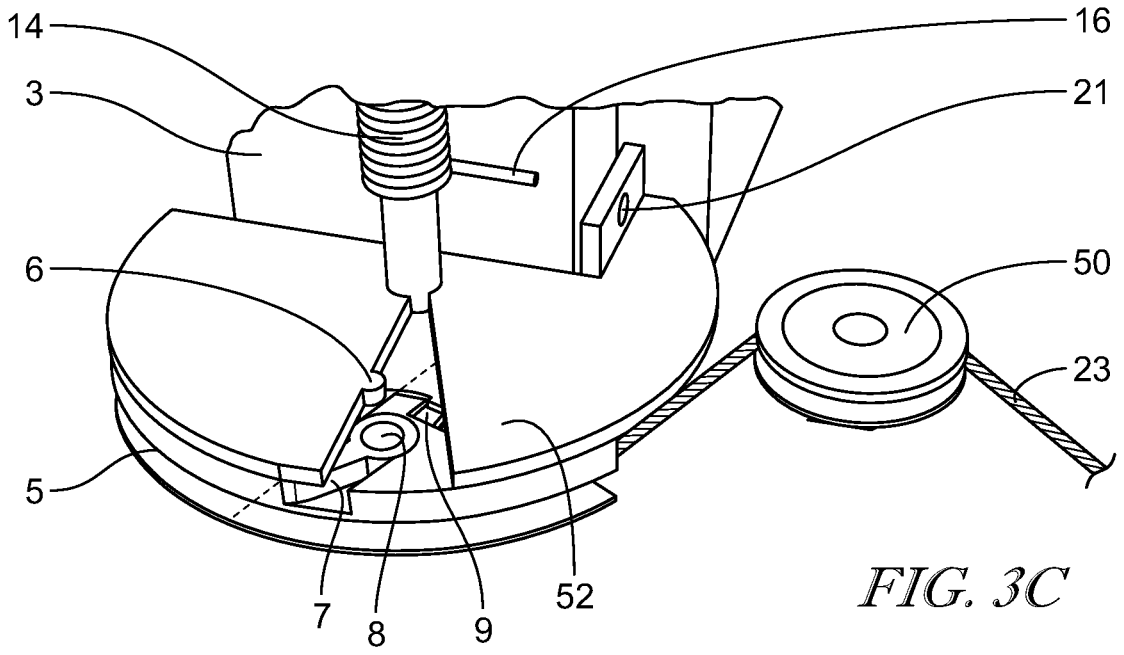
Figure 3D:
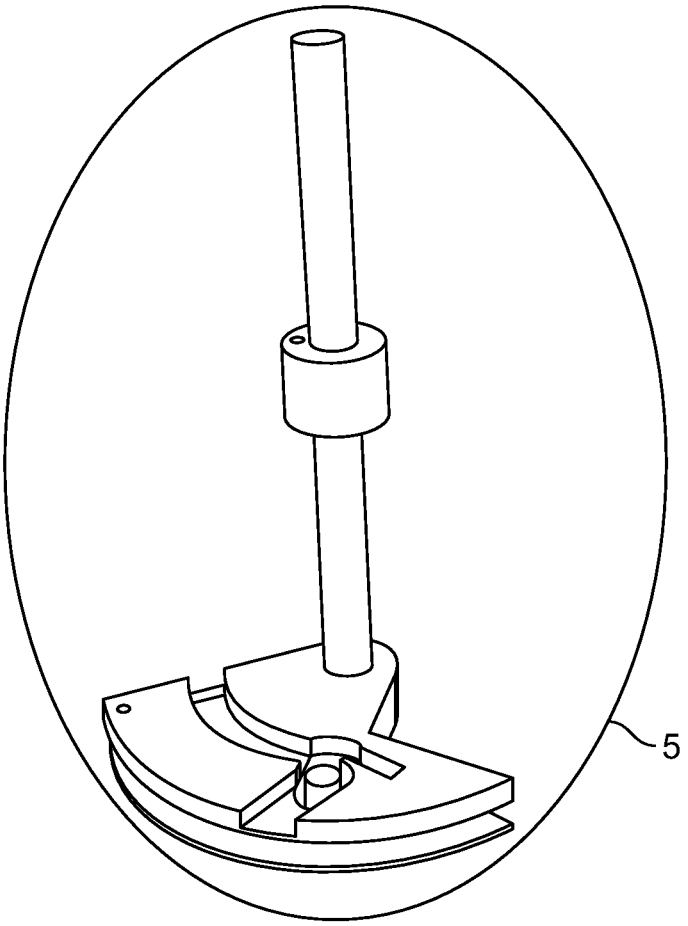
Figure 4A:
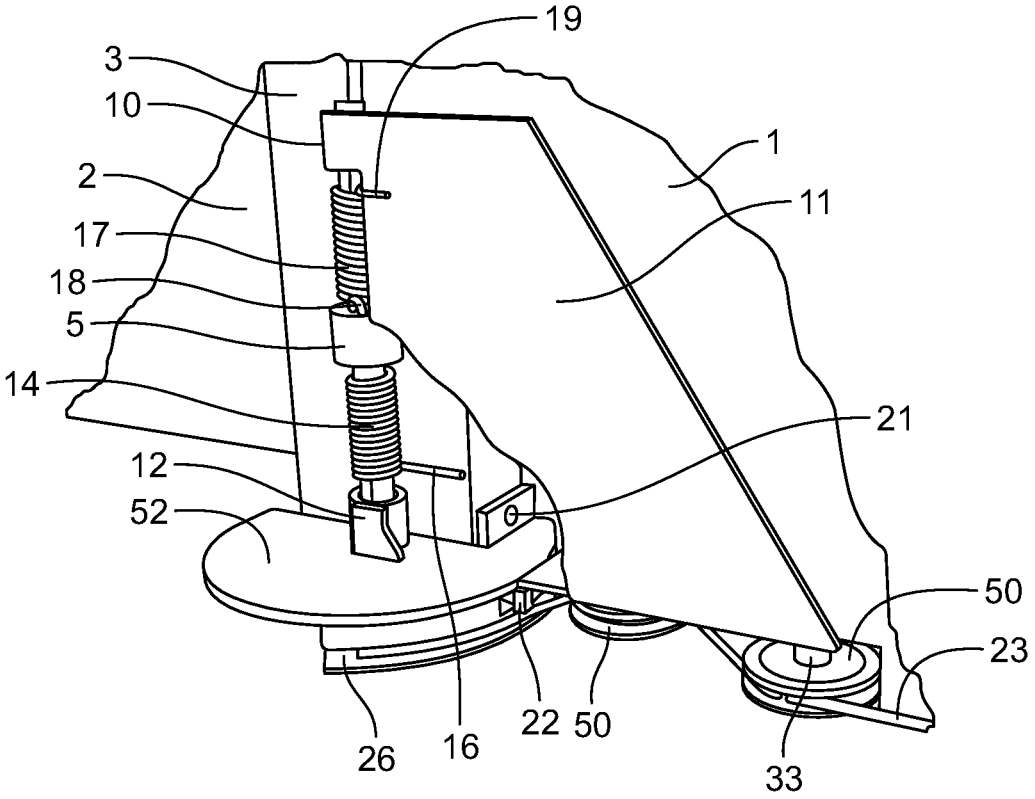
Figure 4B:
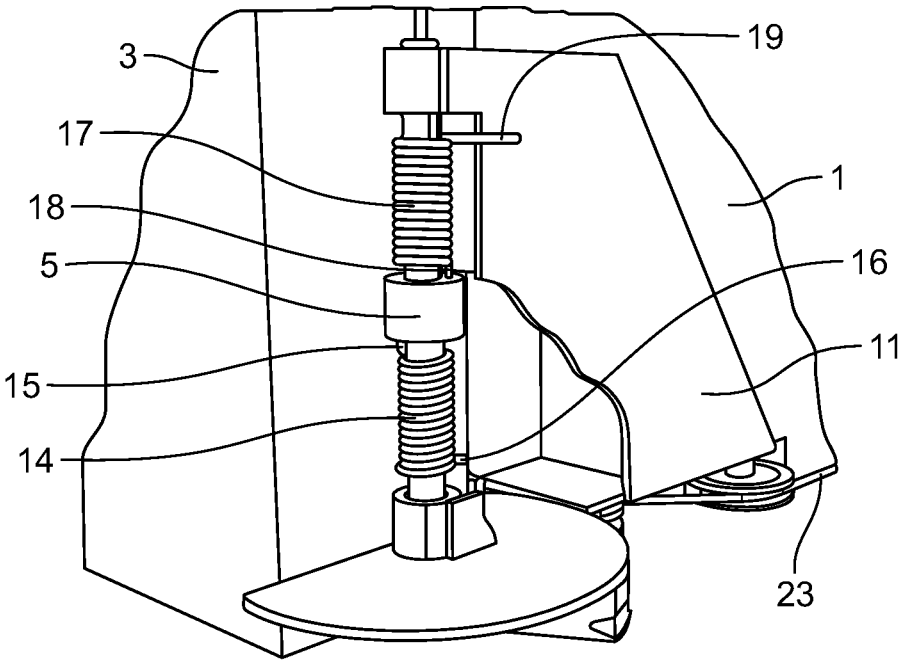
Figure 4C:
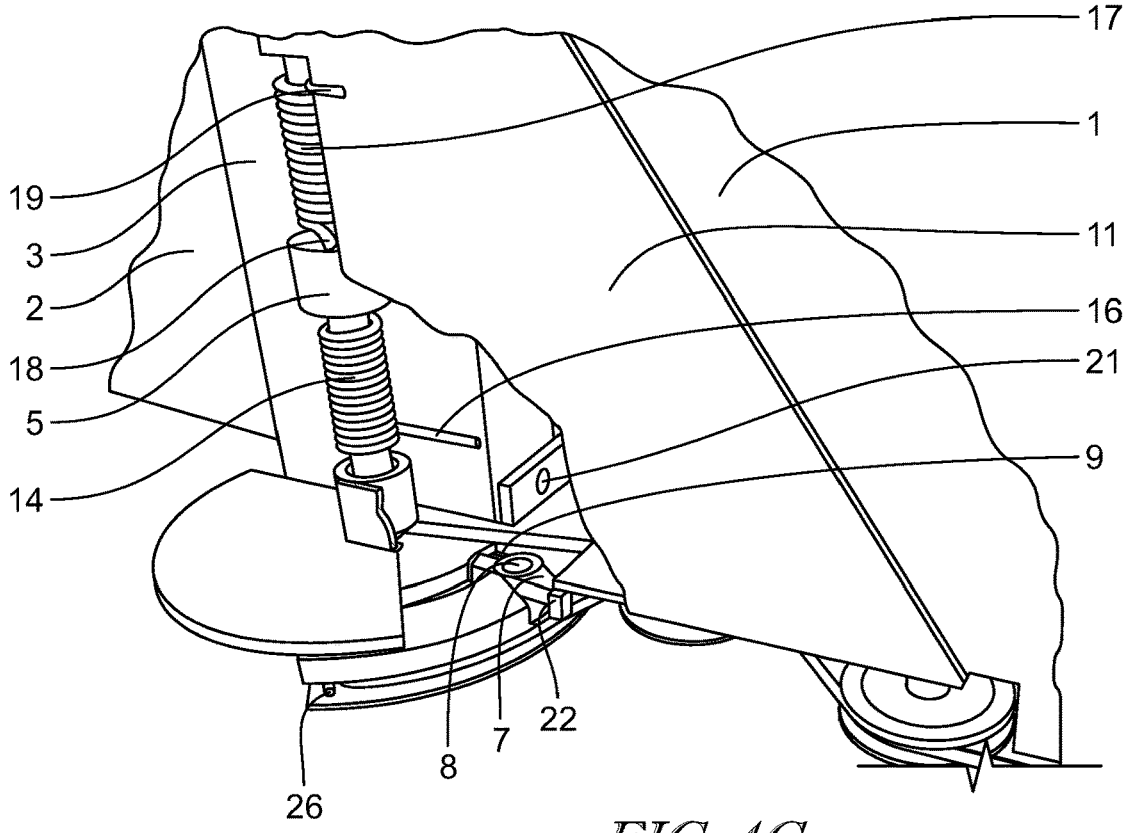
Figure 4D:
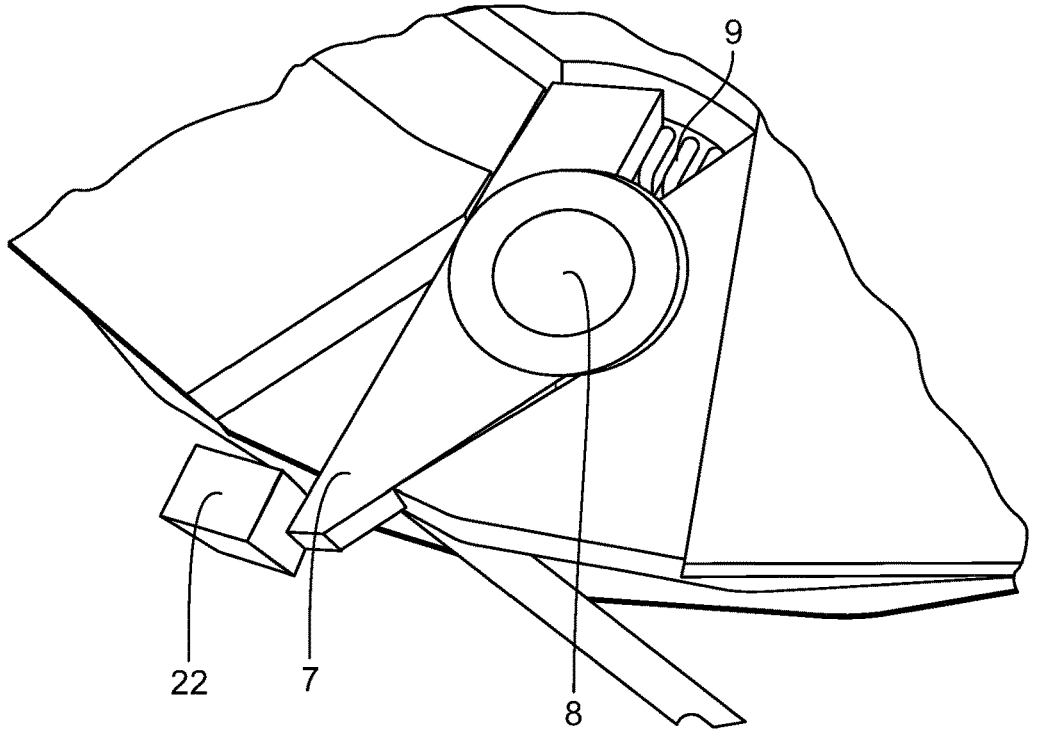
Figure 5A:
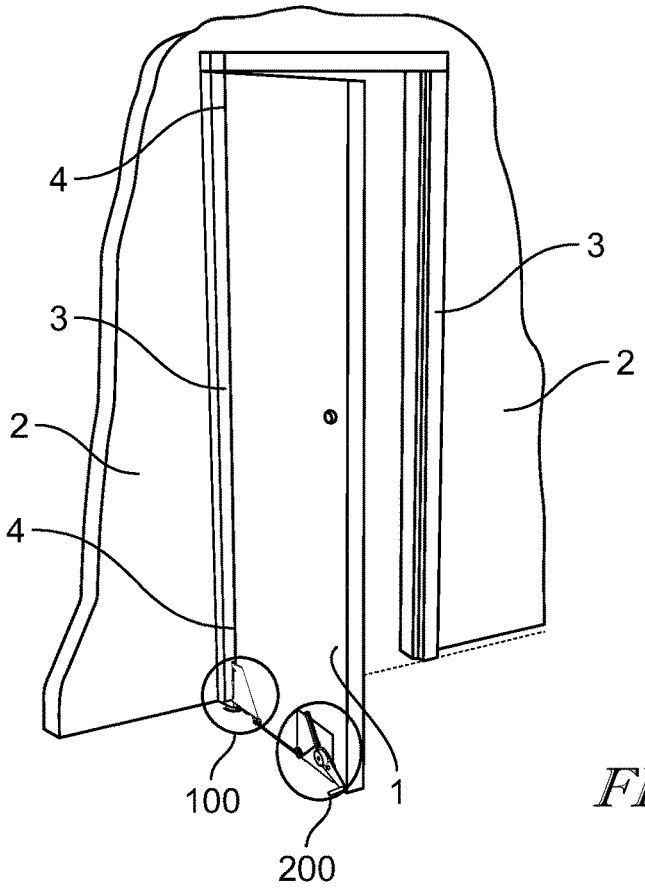
Figure 5B:
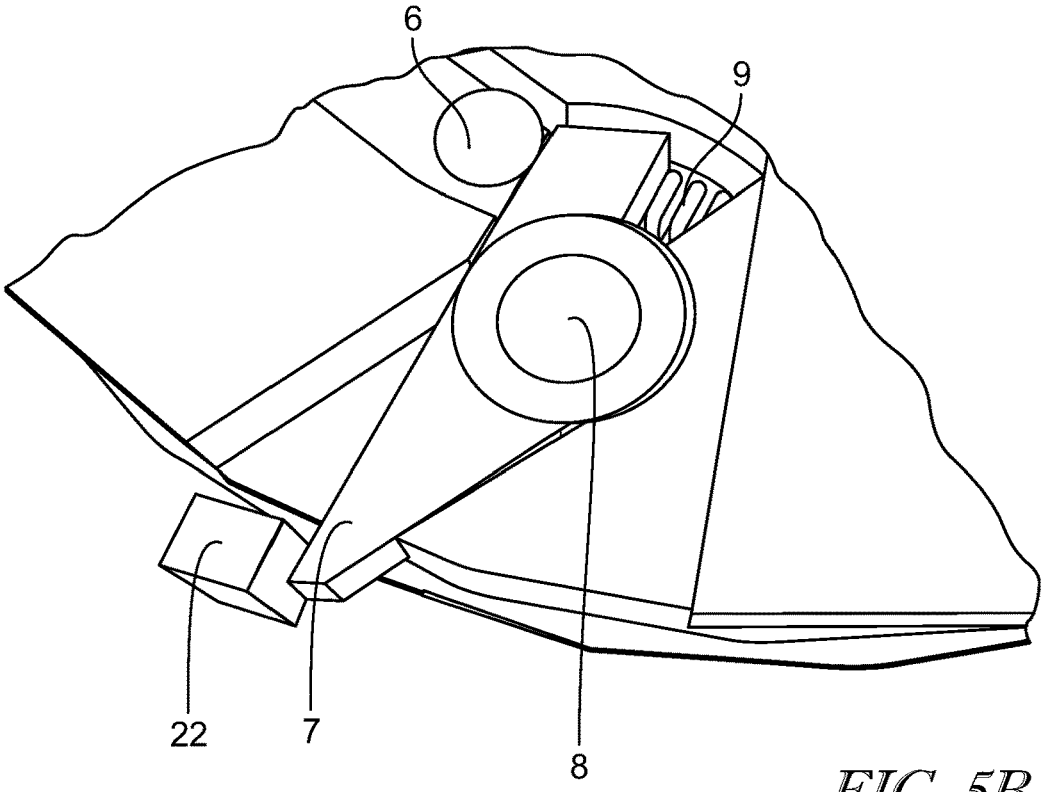
Figure 5C:
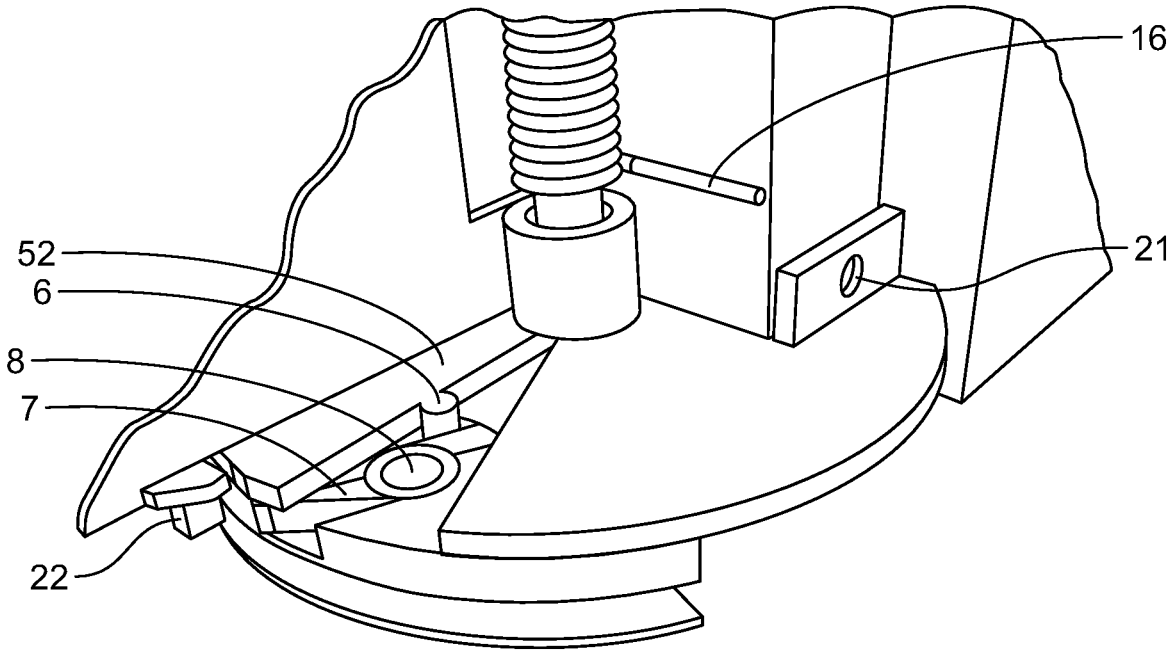
Figure 5D:
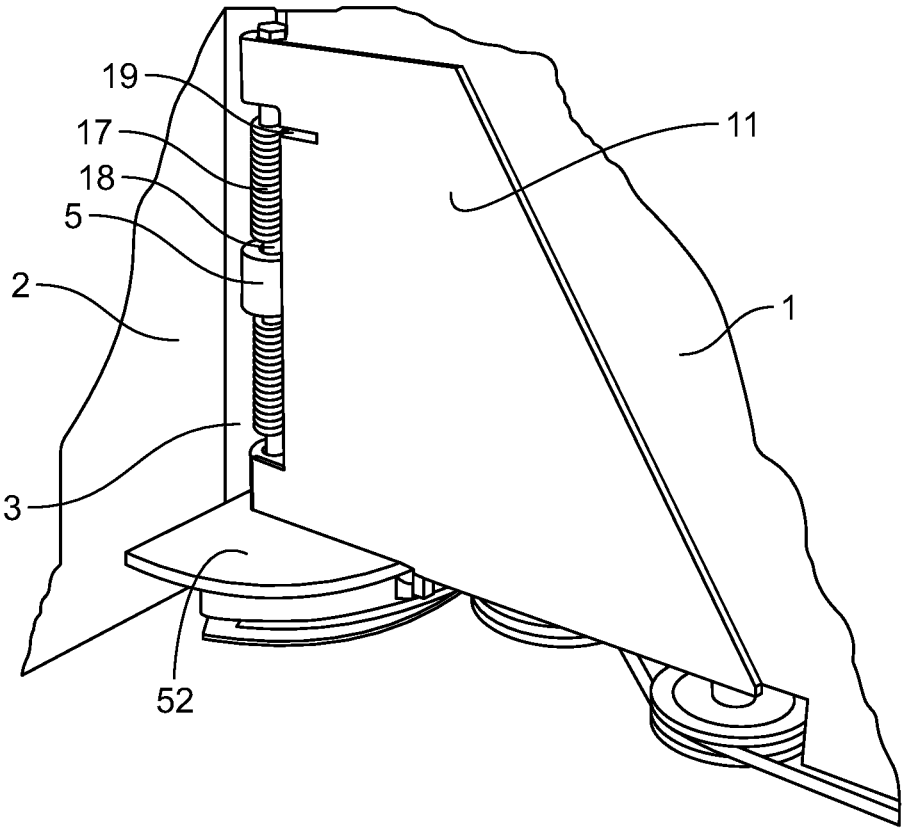
Figure 6A:
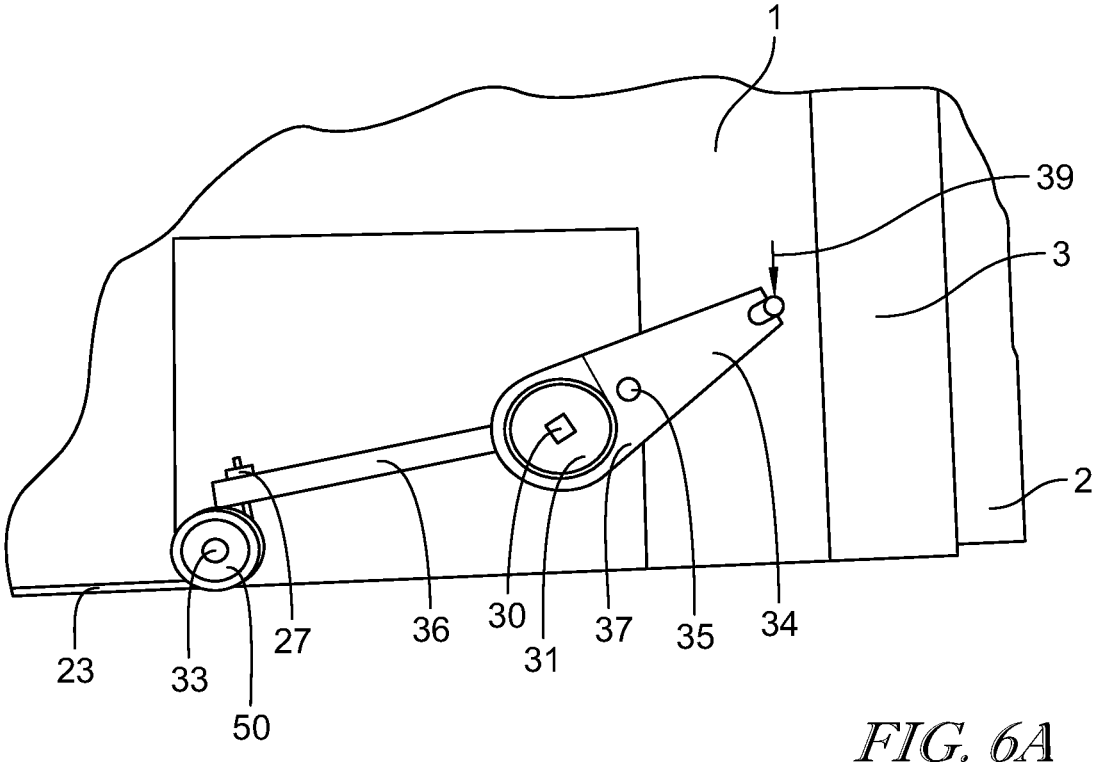
Figure 6B:
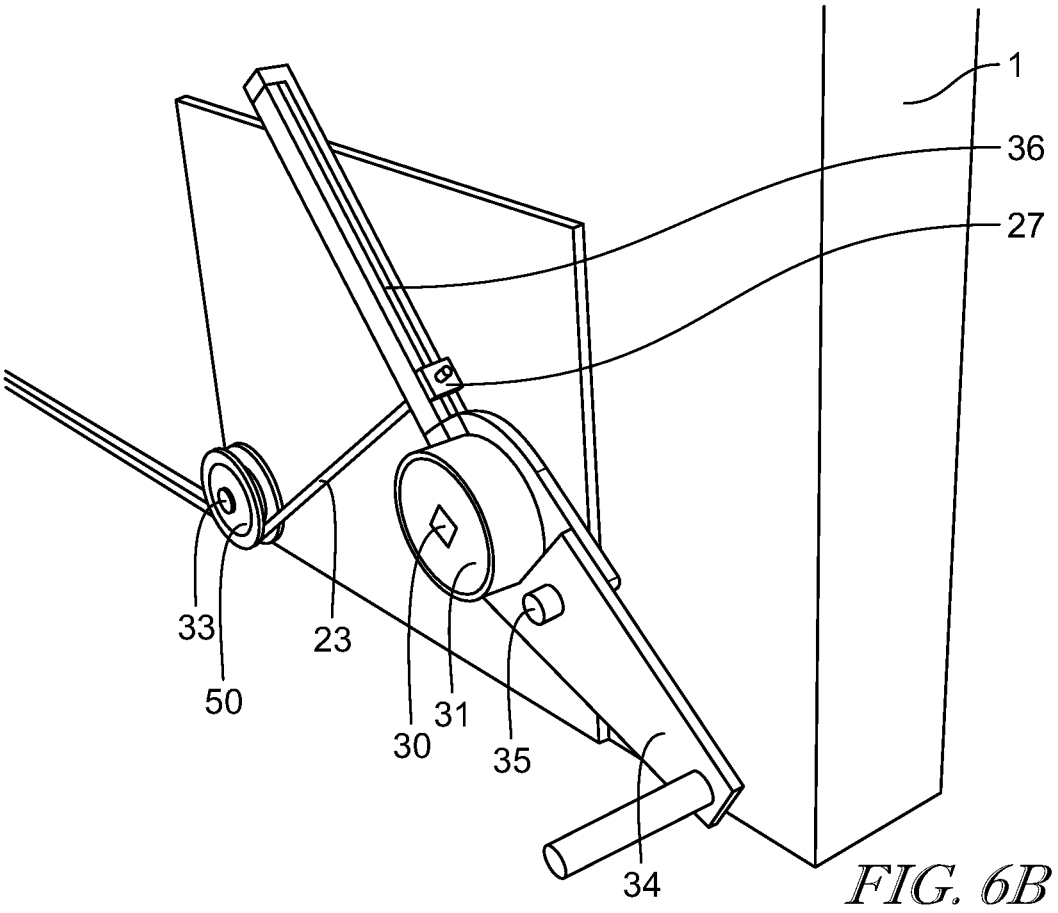
Figure 7A:
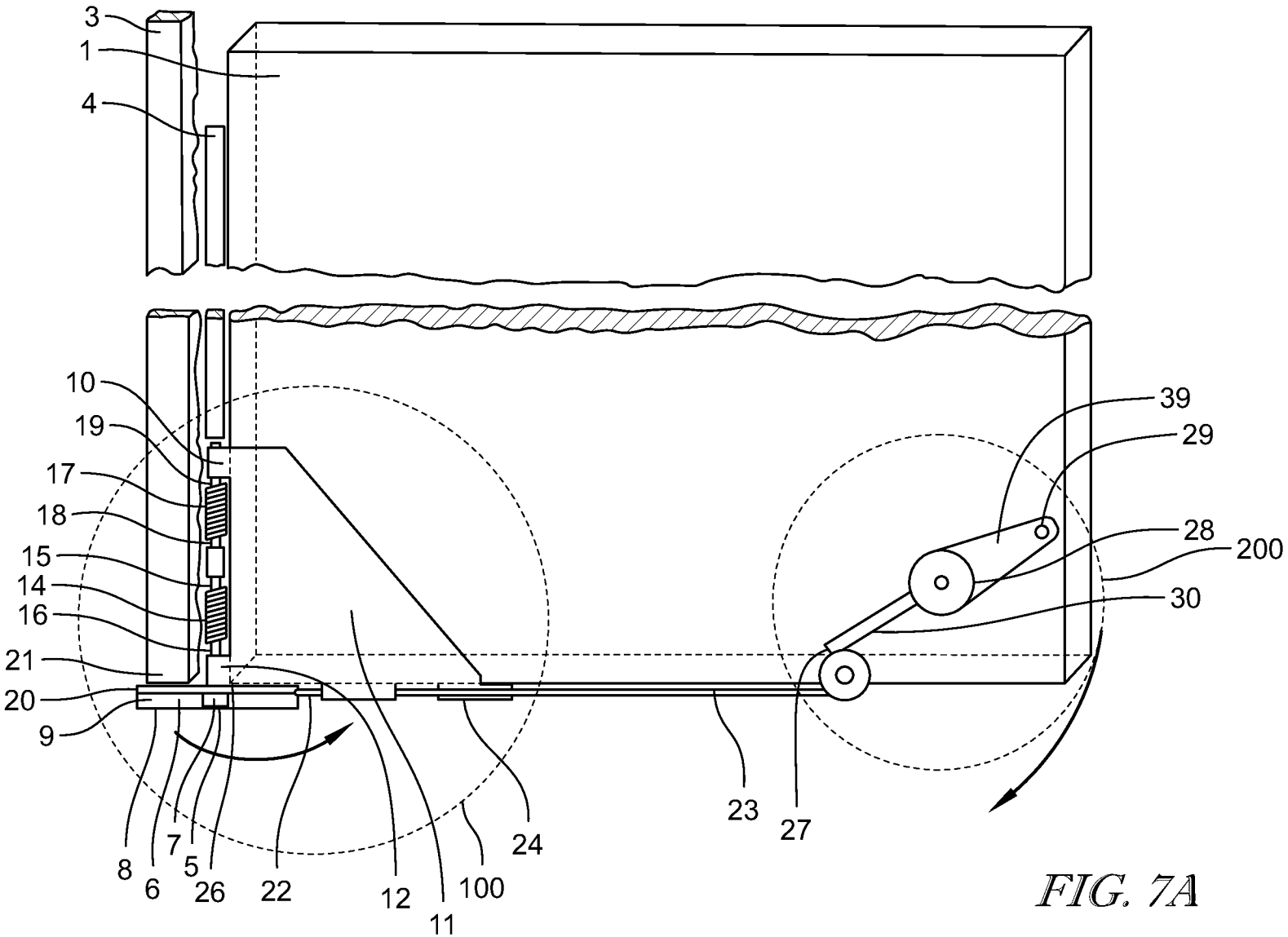
Figure 7B:
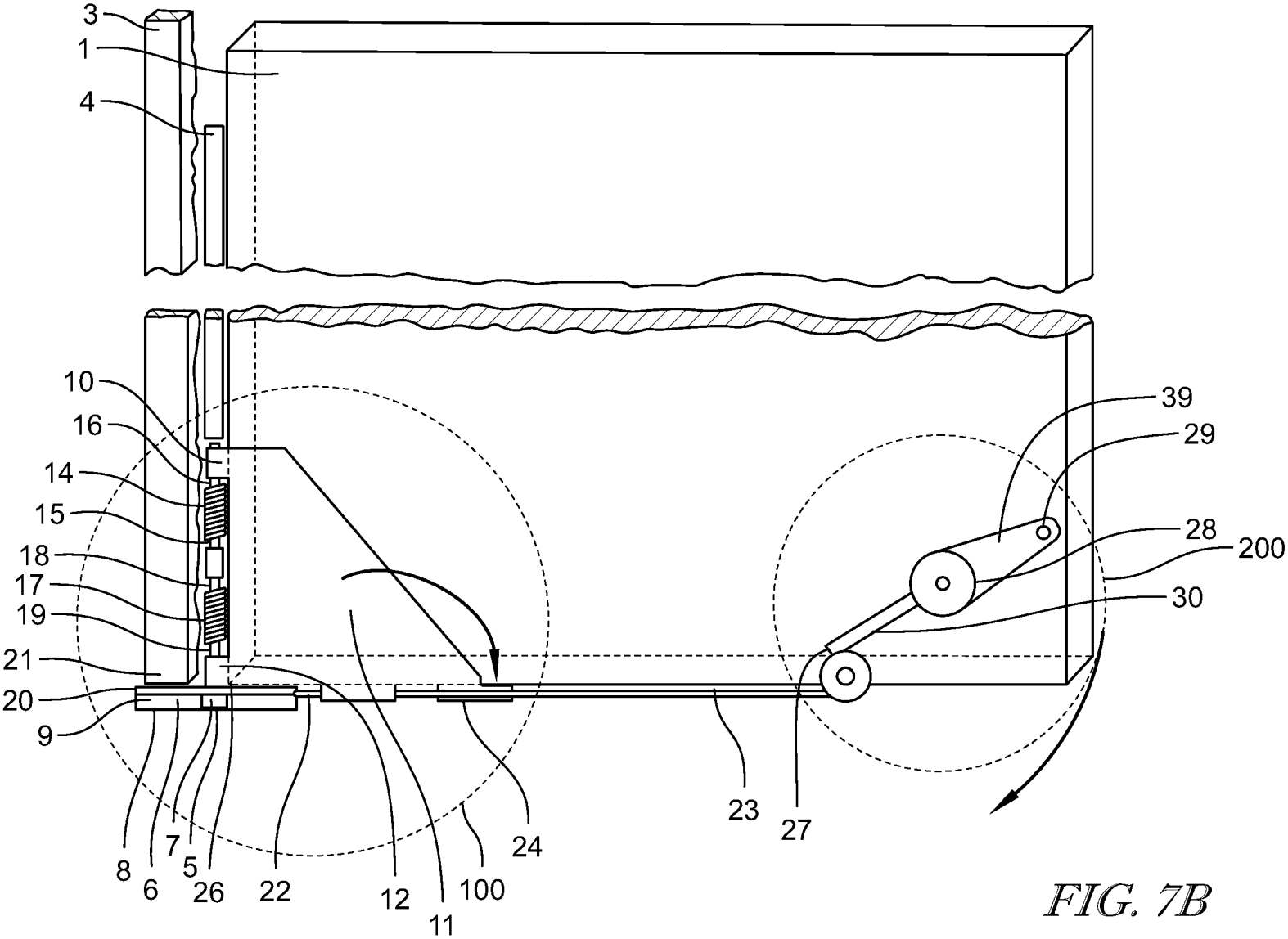

FIG. 3*a* shows a non-activated state of the opening and closing mechanism,

FIG. 3*b* shows a non-activated state of the opening and closing member, which is made as torsion springs, FIG. 3*c* shows the latch positioned in an non-activated state, FIG. 3*d* shows the rotating member, FIG. 4*a* shows a closed door leaf, wherein the opening and closing mechanism is activated, FIG. 4*b* shows the opening and closing member and its mounting, FIG. 4*c* shows the engagement of the carrier on the latch, FIG. 4*d* shows the latch engaged on the carrier, FIG. 5*a* shows a general view of the open door leaf, FIG. 5*b* is a view of the latch just before deactivation, FIG. 5*c* shows a stop deactivating the latch and the carrier on the door leaf leaving the latch on its opposite end, FIG. 5*d* shows the unlocked closing member, FIG. 6*a* shows the control mechanism in an non-activated state indicating the direction of operating force, FIG. 6*b* is a view of a tread activated control mechanism, FIG. 7*a* shows a schematic presentation of the mechanism where activation occurs by moving the rotating member in an opposite direction to the door leaf opening, and FIG. 7*b* shows a schematic presentation of the opening and closing mechanism where activation occurs by moving the rotating member in the same direction to the door leaf opening.

DETAILED DESCRIPTION

Because the disclosed embodiments relate to a control system of one door leaf, which operates independently of a possible control system on a second door leaf, the disclosed embodiments will be further explained by an example of a single-leaf door.

When the opening and closing mechanism 100 is activated, a rotating member 5 can either be rotated in the same or the opposite direction to the rotation of a door leaf 1. In a further explained solution the closing mechanism is used in the opposite direction.

The control mechanism 200 can be implemented by various technical means. A variant with the control mechanism 200 is that the mechanism 200 provides for optimization of a driving force with continuous automatic shift of the gear ratio.

In some embodiments, the opening member 14 and the closing member 17 include torsion springs.

Figure 1:
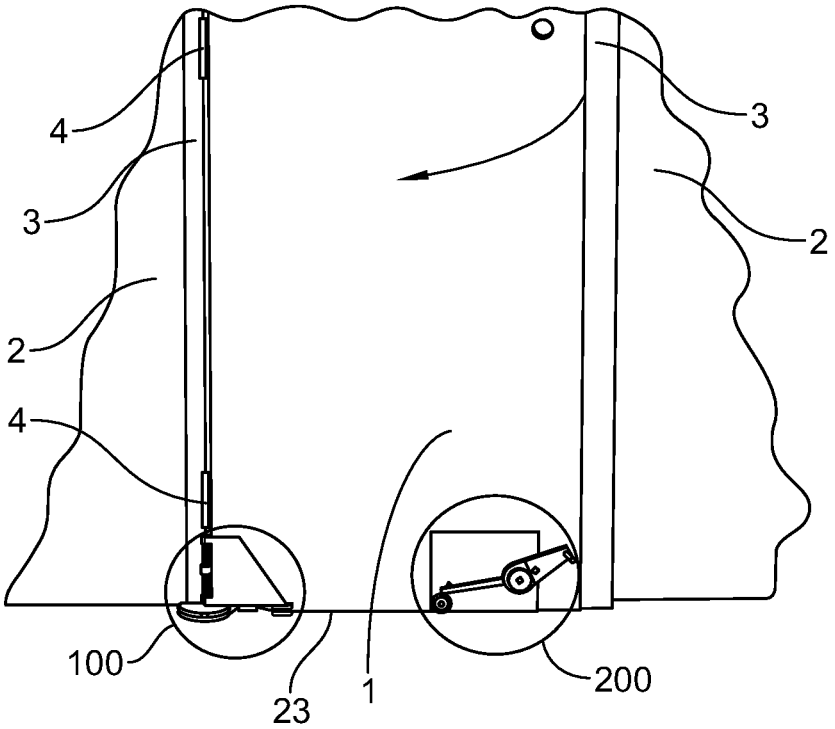
FIG. 1 is an overall view of the device.

FIG. 1 shows an overall view according to the disclosed embodiments. The door leaf 1 is provided with an opening and closing mechanism 100, which can be provided with a commercially available damping device. Furthermore, the door leaf 1 is provided with a control mechanism 200 and a connecting member 23. In this context it should be noted that it may be either a right or left door leaf 1. The edges of the door leaf 1, in the closed position, are positioned adjacent to the frame 3. The door leaf 1 may also be utilized with a "swinging door", which may be open to both sides of the wall 2. In this scenario, the opening and closing mechanism 100 is returned to the closed position temporarily and repeatedly with each swing decreasing amplitude.

Figure 2:
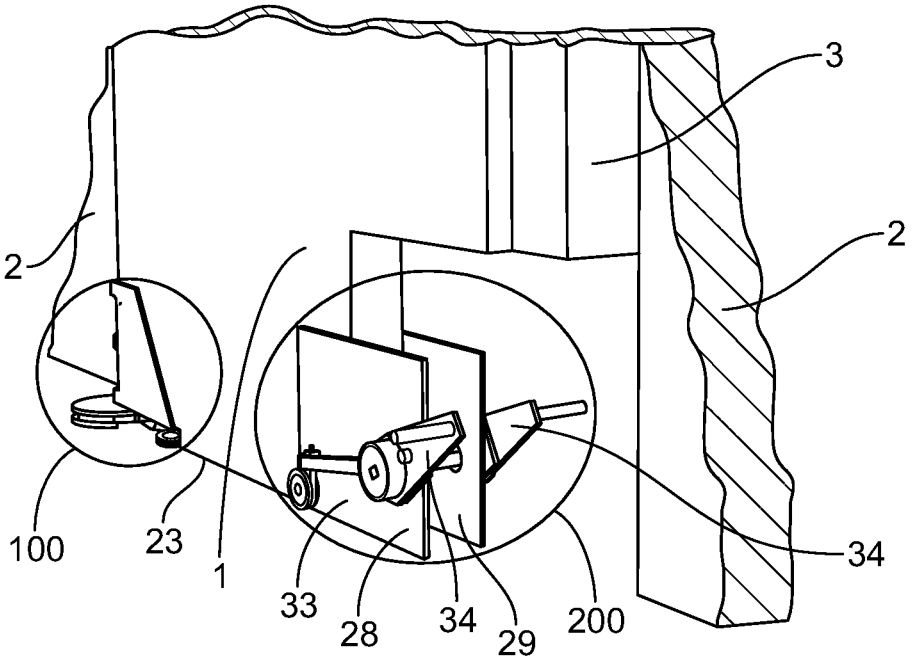
FIG. 2 shows the location of the control mechanism on the side of the opening and closing mechanism and a tread arm and a pivot point on the opposite side of the door.

The present disclosure enables opening of the door leaf 1 away from the passing person and, in particular, towards the passing person and subsequent automatic closure without the need to touch anything on the door by hand. The door leaf 1 is additionally provided with the opening and closing mechanism 100, preferably in the lower part of the door leaf 1. The opening and closing mechanism 100 can be activated using the control mechanism 200 and connecting member 23. For example by pressing the control mechanism 200 with the foot, the door leaf 1 opens and subsequently closes automatically. The opening and closing mechanism 100 is mounted on the side of the door leaf 1 so that the door leaf 1 opens towards the passing person, who would otherwise have had to pull the door leaf 1 by hand. On the opposite side of the door leaf 1, which opens from the passing person, such a control mechanism 200 does not need to be mounted because the passing person could push the door leaf 1 by foot, shoulder, elbow, knee, orthopedic aids, etc. For uniformity of the door leaf 1, it is appropriate that the front part of the control mechanism 28 and the rear part of the control mechanism 29 are arranged on both sides of the door leaf 1, as shown in FIG. 2.

The described example could also be designed so that the opening and closing mechanism 100 does not include a torsion spring, but is pneumatic-hydraulic device, pneumatic device, or a hydraulic energy accumulation device.

For several reasons, a purely mechanical structure may be advantageous. In such an embodiment, the opening member 14 and closing member 17 include a torsion spring that acts as an energy accumulator for opening and closing the door leaf 1.

Opening and closing mechanism 100, according to FIG. 3*a*, includes the rotating member 5, which is shown in detail in FIG. 3*d*. The rotating member includes a rotating segment, which acts as an energy accumulator. When the rotating segment is activated by the control mechanism 200, an actuating force 39 stores energy in the opening member 14 and closing member 17, as shown in FIG. 4*a*. Opening member 14 is shown in FIG. 3*b*. Opening member 14 is fastened by an opening member fastener 15 to the rotating member 5, and an opening member support arm 16 is connected against the frame 3 or directly on the wall. The closing member 17 is fixed by a closing member fastener 18 to the rotating member 5, and the closing member support arm 19 leans on an upper and lower hinge fastener 11, which connects an upper hinge 10, a lower hinge 12 and the door leaf 1. Closing member 17 is mounted with a preloaded force for keeping the door leaf 1 closed. Turning the rotating member 5, a shown in FIG. 4*a*, will accumulate energy in the opening member 14 by twisting the opening spring and simultaneously accumulating energy in the closing member 17 by twisting the closing spring. After rotating the rotating member 5, the strength of the opening member 14 does not act against the force of the closing member 17. This is realized in FIG. 4*c* by the latch 7, which is mounted on a latch pivot point 8. The latch pivot point 8 is located, in the activated state, on a latch spring 9, shown in FIG. 4*d*. During rotation of the rotating member 5, the latch 7 captures the carrier 22, which is secured to the upper and lower hinge fastener 11 of the door leaf 1, shown in FIG. 4*a*. Accordingly, both the closing member fastener 18 and the closing member support arm 19 are connected to the door leaf 1 until latch 7 is released and the function of the closing member 17 is blocked. Opening member 14 acts via a rotating member 5 and latch 7 on the carrier 22 that is mounted on the upper and lower hinge fastener 11, and thus on the door leaf 1, which starts to open, as shown in FIG. 4*d*. When door leaf 1 is fully or almost fully opened, the latch 7 leans on the stop 6 mounted to cover fastener 20 and cover fastener 21 and thus to frame 3 or wall 2, as shown in FIG. 5*c*. The door leaf 1 together with the carrier 22 detaches from the latch 7, which returns to the disengaged position. At this moment, the door leaf 1 starts to disengage from the opening member 14 and the door leaf 1 begins to close automatically by the force stored in the closing member 17.

Furthermore, there is a possibility that the passing person holds the door leaf 1 before the latch 7 is disengaged, for example again by the person's foot. This will ensure that the door leaf 1 with carrier 22 will not have enough inertial force to leave the point of contact with the latch 7, and thus the opening member 14 remains in activated position, as shown in FIG. 5*b*. The door leaf 1, will then remain in the open position. The passing person can, with moderate force applied again by foot to door leaf 1 in the direction of its opening, deactivate the opening member 14 by disengaging the latch 7. This will cause the closing member 17 to engaged and the door starts to close. The same effect can be achieved by moving the door in the closing direction, after release of the door leaf 1, and the door will begin to open again and have enough inertial force to release the latch 7 and follow the standard method described in the preceding paragraph.

Control mechanism 200 may be arranged on one side of the door leaf 1, while on the opposite side of the door leaf 1, control mechanism 200 may be on the same axis arranged next to the tread arm 34, as shown in FIG. 2, without any additional device so that the opening and closing mechanism 100 and the whole door leaf 1 can be controlled in the same way on both sides. The opening and closing mechanism 100 is always mounted on the hinge 4 side of the door leaf 1, as shown in FIG. 1.

FIG. 2 and FIG. 6*a* show the control mechanism 200, which has a tread arm 34, to which an actuating force 39 is applied. The actuating force 39 pivots the tread arm around the pivot point 30 positioned on both sides of the door leaf 1. Tread arm 34 is connected at its other end with the connecting member 23, that is guided via a pulley 50 rotating on a pulley pivot point 33. The front part of the control mechanism 28 and rear the part of the control mechanism 29 if it is mounted, are in disengaged in an upper position from rotating member 5, which is shown in FIG. 3*d* and is shown in the upper position in FIG. 3*a*.

Opening member 14 exerts no force. The closing member 17 develops only the preload force to keep the door leaf 1 closed. The latch 7 is in the disengaged position, shown in FIG. 3*c*, as it leans on the stop 6 mounted on the cover 52, which is attached to cover fastener 21 and thus to the frame 3 and the wall 2. The force of the closing member 17 overcomes the force of latch spring 9 and the opening member 14 does not develop any force because its action is blocked as both the opening member fastener 15 and the opening member support arm 16 are connected to the frame 3 or wall 2.

The schematic arrangement is shown in FIG. 7*a*, which illustrates the operation when opening and closing mechanism 100 is activated by movement of the rotating member 5 against the opening direction of the door leaf 1. The schematic arrangement shown in FIG. 7*b* illustrates the operation when opening and closing mechanism 100 activates the movement of the rotating member 5 in the same direction as the opening of the door leaf 1.

FIG. 6*a* shows the control mechanism 200 in the non-activated state. The connecting member 23, which is guided over a pulley 50, rotating on a pulley pivot point 33 is anchored to the connecting member sliding fastener 27. The connecting member sliding fastener 27 moves along a variable arm 36, depending on the angle of rotation, thereby continuously changing gear to minimize the maximum needed force. Tread arm 34 is mounted on a tread arm pivot 35 and tread arm stop 37 rests on rotatable mounting 31 enable the tread arm 34 to tilt. This arrangement prevents possible injury of a person on the opposite side of door leaf 1 from the passing person.

The front part of the control mechanism 28 and the rear part of the control mechanism 29, if it is mounted, are activated, that is they are in the lower position, shown in FIG. 6*b*, and the rotating member 5 is rotated by 90 degrees, as shown in FIG. 4*a*.

Opening member 14 is rotated by the rotating member 5 via a twist of the opening member fastener 15 against the opening member support arm 16, which leans on frame 3 and wall 2 to develop full torque. The closing member 17 also develops full torque by twisting the closing member fastener 18 against the closing member support arm 19, which leans on the door leaf 1, as shown in FIG. 4*b*. The action of closing member 17 is blocked because both the closing member fastener 18 and closing member support arm 19 are connected to the door leaf 1, as shown in FIG. 4*c*. FIG. 4*c* also illustrates connecting member fastener 26 connected to the rotating member 5.

The latch 7 is in the activated position because it does not lean on the stop 6 and the latch spring 9 keeps it in the activated state, as shown in FIG. 4*d*. The rotation of the rotating member 5 carries the latch 7 to engage the carrier 22 mounted on the upper and lower hinge fastener 11 and thus mounted on the door leaf 1, as shown in FIG. 4*c*. Once the passing person releases the front part of the control mechanism 28 or the rear part of the control mechanism 29 and thus withdraws from the door leaf 1, door leaf 1 begins to open.

FIG. 6*b* shows the control mechanism 200 in activated state. The connecting member 23, which is guided over a pulley 50, rotating on a pulley pivot point 33 anchored to the connecting member sliding fastener 27. The connecting member sliding fastener 27 moves along a variable arm 36, now reaching a second position, ensuring that in the moment where it is necessary to overcome the maximum torques of the opening member 14 and closing member 17 the length of the variable arm 36 is minimal.

The front part of the control mechanism 28 and the rear part of the control mechanism 29, if it is mounted, are in the activated position, as shown in FIG. 5*a* and FIG. 6*b*. The rotating member 5 is close to the basic position and deactivates the latch 7, as shown in FIG. 5*b*. The opening member 14 member develops only residual torque. The closing member 17 develops full torque, but its action is blocked because both closing member fastener 18 and the closing member support arm 19 are connected to door leaf 1.

This solution has a number of technical and economic benefits, including the possibility of installation on an existing door leaf 1 and the fact that the solution does not fundamentally affect the function and operation of the door leaf 1 when the opening and closing mechanism 100 is not activated, it works only as a closer.

The disclosed embodiments are applicable in all fields where it is necessary to open and close the door without touching it with human hand due to hygienic reasons, or even in cases where the opening by hand is difficult, for example when the passing person has full hands.

Another possible function is to stop the door in the open position. That could be advantageous for example for hospitals, restaurants, storage etc.

The invention claimed is:

1. A device for controlling doors comprising:

a door leaf coupled to a door frame a moveable between a closed position and an open position, a control mechanism coupled to the door leaf and configured to receive an actuating force, a rotating member connected to the door leaf and coupled to the control mechanism by a connecting member, an opening member having an opening member fastener and an opening member support arm, wherein the opening member is connected to the rotating member and the door frame, a closing member having closing member fastener and a closing member support arm, wherein the closing member is connected to the rotating member and the door leaf, and a latch configured to couple and uncouple the opening member to the door leaf via the rotating member by selectively connecting the rotating member to either the door frame or the door leaf, wherein, the control mechanism receives the actuating force when the door leaf is in the closed position and the latch couples the opening member and the closing member via the rotating member to the door leaf by latching on a carrier attached to the door leaf, wherein the actuating force rotates the opening member and closing member via the connecting member and the rotating member to accumulate an opening force in the opening member and a closing force in the closing member, wherein, when the control mechanism receives the actuating force and the latch engages the carrier, the closing member fastener and the closing member support arm of the closing member engage the door leaf so that the closing force is blocked against the door leaf, wherein, when the control mechanism receives the actuating force and the latch engages the carrier, the opening member fastener of the opening member is positioned against the door leaf due to the engagement of the latch on the rotating member with the carrier on the door leaf and the opening member support arm of the opening member is positioned against the door frame so that the opening force opens the door leaf when the control mechanism is disengaged and the door leaf moves to the open position, wherein, when the door leaf reaches a position preset by a stop and the latch disengages from the carrier, the opening member fastener and the opening member support arm of the opening member engage the door frame via engagement of the latch with the stop so that the opening force is blocked against the door frame in the open position, wherein, when the stop hits the latch and the latch disengages from the carrier, the closing member fastener of the closing member is positioned against the door frame through the rotating member and the closing member support arm of the closing member is positioned against the door leaf, and wherein, when the door leaf reaches a fully open position which corresponds with the latch leaning on the stop, the door leaf starts to disengage from the opening member and the door leaf beings to close automatically by the force stored in the closing member.

2. The device of claim 1, wherein the opening member and closing member each include springs.

3. The device of claim 1, wherein the rotating member is arranged in a lower part of the door leaf.

4. The device of claim 1, wherein the control mechanism is arranged in a lower part of the door leaf and includes a tread leg for operation with a foot.

* * * * *